United States Patent [19]

Patterson

[11] Patent Number: 4,762,227

[45] Date of Patent: Aug. 9, 1988

[54] RESILIENT HOUSING FOR REMOTE CONTROLLERS

[76] Inventor: Robert C. Patterson, 6736 Mantova, Long Beach, Calif. 90815

[21] Appl. No.: 122,386

[22] Filed: Nov. 19, 1987

[51] Int. Cl.[4] ..... B65D 85/38

[52] U.S. Cl. ..... 206/328; 206/305; 206/45.31; 206/523

[58] Field of Search ..... 206/37, 38, 305, 328, 206/334, 349, 460, 523, 524, 45.31; 312/7.1, 7.2, 208

[56] References Cited

U.S. PATENT DOCUMENTS

| | | | |
|---|---|---|---|
| 4,075,702 | 2/1978 | Davies | 206/305 |
| 4,300,610 | 11/1981 | China | 206/37 |
| 4,420,078 | 12/1983 | Belt et al. | 206/305 |
| 4,560,069 | 12/1985 | Simon | 206/523 |
| 4,711,347 | 12/1987 | Drexler et al. | 206/38 |

OTHER PUBLICATIONS

Universal Package, Technical Notes–A Publication of RCA John E. Croft, Dec. 30, 1968.

*Primary Examiner*—David T. Fidei
*Attorney, Agent, or Firm*—I. Michael Bay-Boychuk

[57] ABSTRACT

A resilient enclosure for receiving a remote signaling, hand-held assembly includes a layered resilient foam pad comprising a rectangular base onto which a segmented layer is adhered. One or more parts of the layer are then removed to define an opening in which the hand-held assembly is received. A two-ply transparent cover may then be positioned over the pad having segments of the interior ply thereof, removed in correspondence with the remaining segments of the pad. The interply adhesive thus exposed is then useful to secure the cover to the pad.

3 Claims, 2 Drawing Sheets

RESILIENT HOUSING FOR REMOTE CONTROLLERS

BACKGROUND OF THE INVENTION

1. Field of the Invention

The present invention relates to protective enclosures and, more particularly, to a resilient enclosure conformed to receive an electronic housing.

2. Description of the Prior Art

Resilient enclosures for precision devices have been variously implemented in the prior art. Most frequently the resilient housing conforms to the exterior shape of the device enclosed, accommodating the specific detail of the device. As result each resilient housing is uniquely conformed for a particular device.

Recently, a family of electronic remote signaling devices has come to the marketplace as exemplified by hand-held television remote controllers, garage door signaling devices and other similar articles. Each of these devices is characterized by a rectangular enclosure of a size conformed for grasping by a person's hand, and may include on the surface thereof one or more signal keys for controlling it signal output. Typically, such devices effect remote signaling by ultraviolet (UV) radiation, ultrasonic sound frequency, or radio frequency signals. Consequently, one edge of the device often includes an aperture or window particularly when ultraviolet or ultrasonic signal carrier is used.

While each of the foregoing devices typically includes housing structures particularly devised for rugged use, a substantial incidence of damage, nonetheless, persists when the article is dropped or exposed to water.

Consequently, protective coverings for such articles are desired, particularly of a universally adapted geometry for the various planforms of signaling devices now available in the marketplace.

SUMMARY OF THE INVENTION

Accordingly, it is the general purpose and object of the present invention to provide a resilient enclosure conformed to receive a variety of signaling devices.

Other objects of the invention are to provide a resilient enclosure for a signaling device which may be selectively conformed to the geometry of the device.

Yet further objects of the invention are to provide a universally conformable protective assembly useful with a variety of remote signaling devices.

Briefly, these and other objects are accomplished within the present invention by providing a generally rectangular foam rubber pad characterized by a lower layer adhered to a segmented upper layer, arranged in removeable portions thereon, which may be selectively removed to present a cavity into which the signaling device is received. A two-ply translucent elastic membrane is similarly portioned on its lower ply. The corresponding portions of this lower ply can then be removed to expose the adhesive which then engages those parts of the upper layer that remain.

Preferrably, the upper portioned foam rubber layer is of a thickness greater than the thickness of the device. Consequently, when the plied membrane is stretched thereover a spaced alignment results over any keys on the device. The user then effects the signal selection by depressing the membrane over the desired key, thereby depressing the subjacent key. In the course of such articulation the raised edges of the upper layer deform inwardly to provide the resilient stretch to the membrane.

In this form the device is fully enclosed by resilient or elastic surfaces which provide protection from mechanical shock or exposure to moisture.

DESCRIPTION OF THE PREFERRED EMBODIMENT

Figure 1:
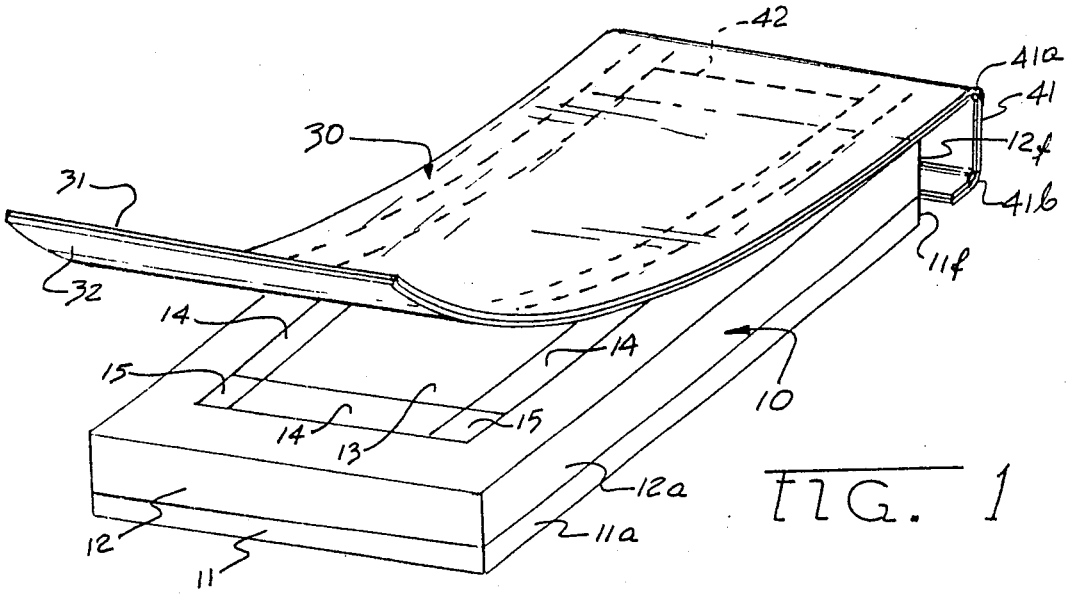
FIG. 1 is a perspective illustration, separated by parts, of the inventive enclosure conformed prior to the use thereof.
Figure 4:
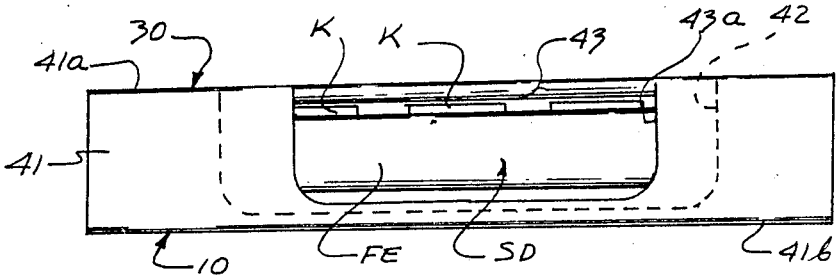
FIG. 4 is an unsectioned exterior end view of the inventive disclosure.
Figure 5:
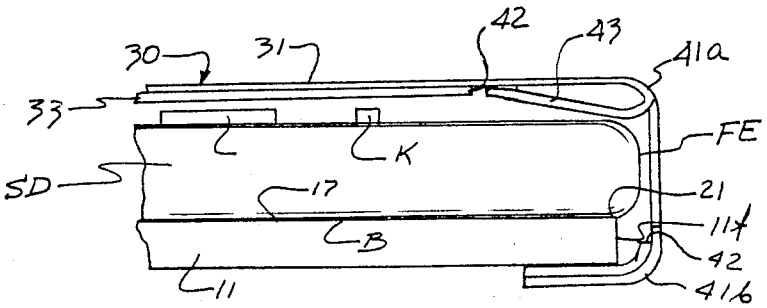
FIG. 5 is a sectional side view taken along Line 5—5 of FIG. 4.
Figure 2:
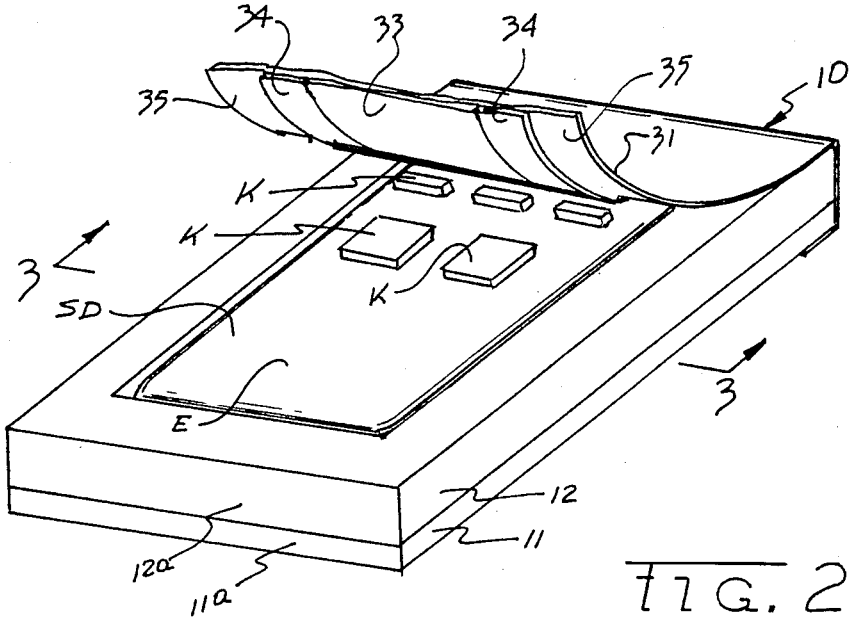
FIG. 2 is yet another perspective illustration of the inventive enclosure in the used configuration thereof.
Figure 3:
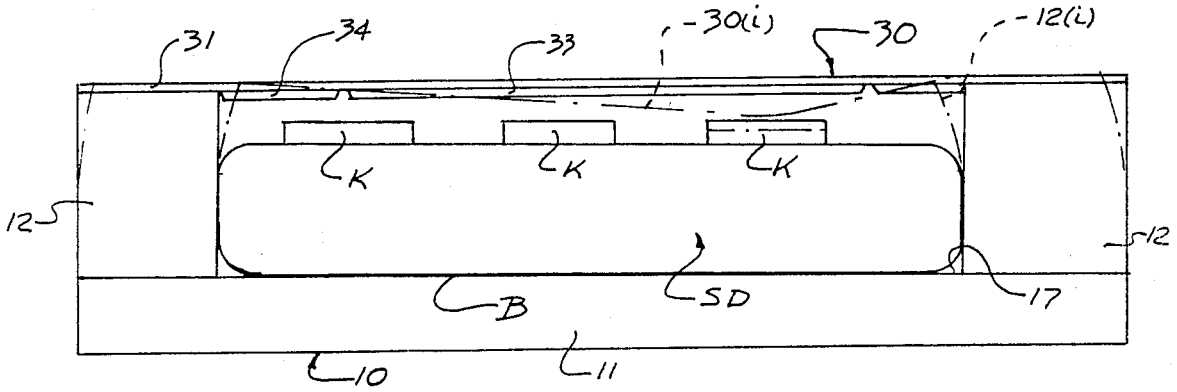
FIG. 3 is a sectional end view taken along Line 3—3 of FIG. 2.

As shown in FIGS. 1–5, the inventive enclosure, generally designated by the numeral 10, includes a base foam rubber layer 11 adhesively secured to a segmented or portioned foam layer 12. Both the base and the portioned layers 11 and 12 are formed to a common rectangular exterior planform defined by common peripheral edges 11*a* and 12*a* with the portioned layer 12 including plural central segments 13, 14 and 15 which may be selectively peeled off the base layer 11.

Of course, the user then selects which of the segments 13–15 are then peeled off to accomodate the exterior shape of a particular signaling device SD. Once thus peeled off the removed segmentes expose an adhesive surface 17 on the base layer 11 against which the back surface B of the device SD is adhered. Thus, the device SD is fully cradled within the remaining portions of layer 12 which, preferrably, extend to a thickness greater than the depth of the device SD.

In typical form device SD includes one or more keys K on its exposed surface E which are to be selectively depressed to render the device useful. Moreover, the device SD often includes a port or aperture in its forward edge FE through which the ultrasonic, ultraviolet or radio frequency signal is radiated. This aperture alignment at the forward edge is in consequence to the directional character of the radiated signal which is typically effected for positive control.

Accordingly, segments 13 and 14 preferrably extend to the common forward edge 11*f* and 12*f* of layers 11 and 12 and when these segments are peeled off an edge opening 21 is then formed. Thus, when the device SD is positioned within the cavity its forward, signaling edge FE is exposed through opening 21.

A two-ply, adhesively affixed, translucent cover, generally at 30, is similarly formed to include an exterior ply 31 onto which a segmented, interior ply 32 is adhered. Once again, the interior ply 32 is segmented into segments 33 and 34 which then, upon alignment, will overlie the above-mentioned segments 13, 14 and 15.

The user then, may once again, peel off those portions of ply 32 which align with the portions of layer 12 left in place. The adhesive 35 exposed in the course of peeling is then used in adhering membrane 30 to the surfaces of layer 12.

In the preferred form herein layer 12 is formed to a thickness greater than the depth of the device SD and the keys K thereon. In consequence the adhered membrane 30 extends in a spaced relationship over the keys. Thus, when the membrane is depressed over the desired key K lateral deformation occurs in the peripheral portion of the layer 12, shown at 12(*i*) and 30(*i*). This resilient lateral deformation effects the necessary stretch to the membrane for selecting a single key only.

Membrane 30, moreover, includes a forward folded section 41, defined by two spaced fold lines 41*a* and 41*b*, again of plied construction provided with a rectangular portion 42 in the ply 32 and a scribed segment 43 in ply 31. Portion 42 and segment 43 may be selectively left on or peeled off to form either a translucent cover or an aperture 43*a* over the edges 11*f* and 12*f* thus spanning the end opening 21. When an aperture is formed the scribed segment 43 is folded onto the adjacent adhesive surface of ply 31 exposed by removing portion 42.

In this form a variety of commercial forms of a signaling device SD may be conveniently protected, the edges of the resilient structure providing the necessary attenuation against shock caused by dropping the article.

Obviously many modifications and changes may be made to the foregoing description without departing from the spirit of the invention. It is therefore intended that the scope of the invention be determined solely on the claims appended hereto.

What is claimed is:

1. A resilient protective enclosure for receiving remote signaling articles, comprising:

a substantially rectangular resilient pad including a base layer adhesively secured to a segmented receiving layer defined by a plurality of adjacent segments releasably adhered to said base layer whereby a combination of one or more of said segments may be removed from said base layer to receive said article between the remaining ones thereof; and a transparent cover conformed for adhesive attachment to said pad and including an exterior ply adhesively secured to a portioned interior p1y defined by a plurality of portions releasably adhered to said exterior ply, whereby the removal of selected ones of said portions will present the adhesive therebetween against the remaining ones of said segments.

2. Apparatus according to claim 1 wherein:

said segmented layer is formed to a thickness greater than the thickness of said article.

3. Apparatus according to claim 2 wherein:

said resilient pad comprises elastomeric foam material structure.

* * * * *